US006807831B2

(12) United States Patent
Roth

(10) Patent No.: US 6,807,831 B2
(45) Date of Patent: Oct. 26, 2004

(54) NEEDLE WITH TRANSFER SPRING

(75) Inventor: Richard Roth, Albstadt (DE)

(73) Assignee: Groz-Beckert KG, Albstadt (DE)

( * ) Notice: Subject to any disclaimer, the term of this patent is extended or adjusted under 35 U.S.C. 154(b) by 0 days.

(21) Appl. No.: 10/463,591

(22) Filed: Jun. 18, 2003

(65) Prior Publication Data

US 2003/0233853 A1 Dec. 25, 2003

(51) Int. Cl.[7] ..... D04B 35/02
(52) U.S. Cl. ..... 66/123
(58) Field of Search ..... 66/123, 116, 119, 66/120, 121, 122

(56) References Cited

U.S. PATENT DOCUMENTS

| | | | | | |
|---|---|---|---|---|---|
| 885,150 | A | * | 4/1908 | Foster | 66/24 |
| 1,418,345 | A | * | 6/1922 | Witherell | 66/95 |
| 2,111,476 | A | * | 3/1938 | McAdams | 66/95 |
| 2,667,770 | A | * | 2/1954 | Sirmay | 66/95 |
| 4,089,192 | A | * | 5/1978 | Kohorn | 66/123 |
| 4,580,419 | A | * | 4/1986 | Vincoli | 66/123 |
| 4,646,542 | A | | 3/1987 | Tenconi | |
| 6,298,693 | B1 | * | 10/2001 | Schaffer | 66/123 |

FOREIGN PATENT DOCUMENTS

| | | | | |
|---|---|---|---|---|
| DE | 24 58 009 | | 4/1976 | |
| DE | 28 47 972 C2 | | 3/1980 | |
| DE | 2847972 | * | 3/1980 | 66/123 |
| DE | 199 05 668 A1 | | 8/2000 | |
| DE | 19905668 | * | 8/2000 | 66/123 |
| EP | 0 208 193 | | 1/1987 | |
| JP | 52-58164 | | 4/1977 | |
| JP | 56-101960 | | 8/1981 | |
| JP | 57-167797 | | 10/1982 | |
| JP | 59-211661 | * | 3/1984 | 66/123 |
| JP | 59-211661 | | 11/1984 | |
| JP | 6-38140 | | 10/1994 | |

* cited by examiner

*Primary Examiner*—Danny Worrell
(74) *Attorney, Agent, or Firm*—Venable LLP; Stuart I. Smith

(57) ABSTRACT

A needle (1) for loop-forming machines has a needle body (2) with two even flat sides (6, 7), which are joined to one another on the top and back sides of the needle by narrow sides (5, 8). A narrow slit opens out at one of the narrow sides and extends parallel or at an acute angle to the flat sides (6, 7) into the needle body. A substantially rectangular fastening portion (21) of the transfer spring (14) is retained in this slit (16) by positive and/or nonpositive and/or material engagement.

11 Claims, 3 Drawing Sheets

NEEDLE WITH TRANSFER SPRING

Figure 1:
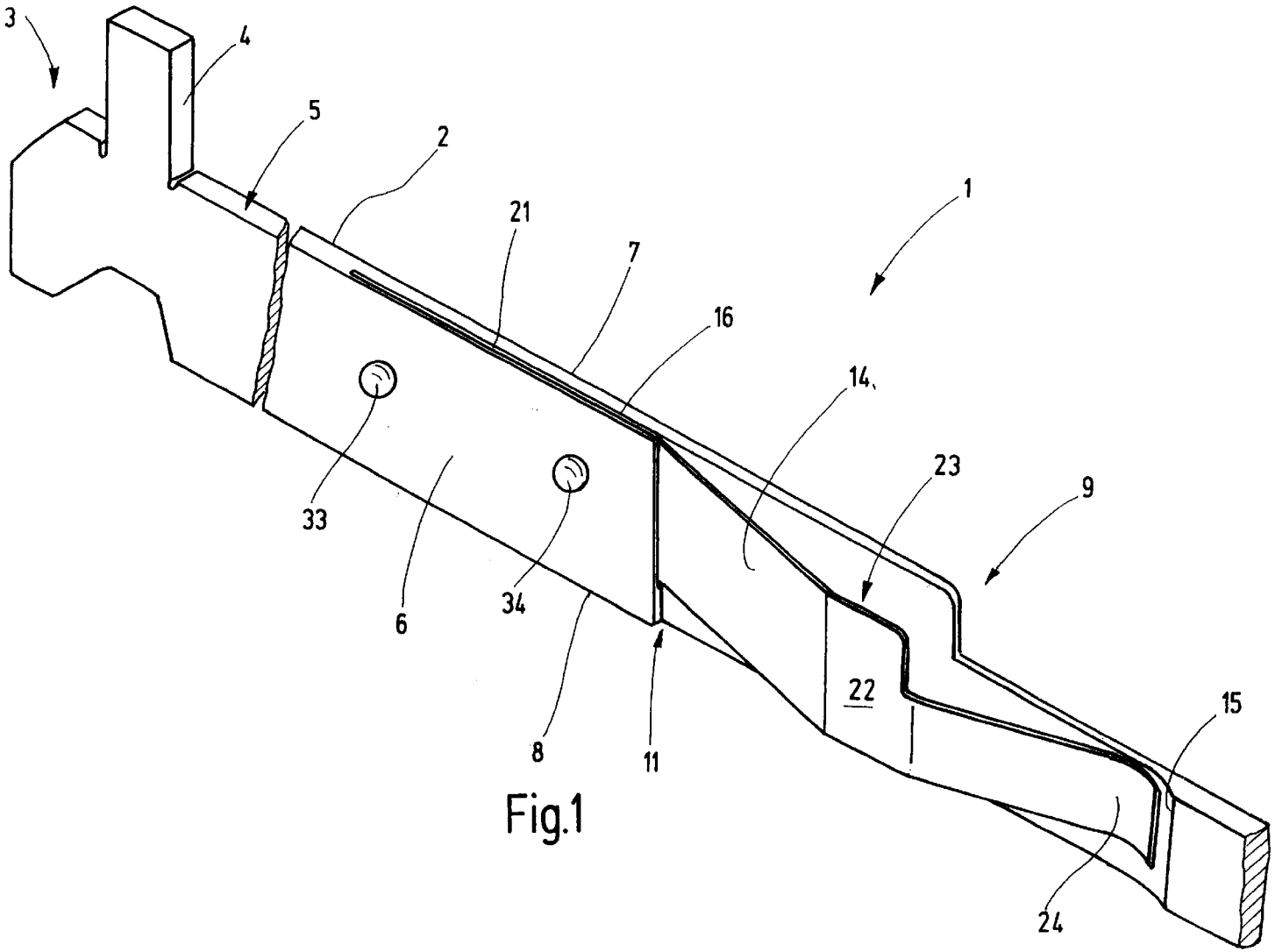

The invention relates to a needle for loop-forming textile machines, in particular a transfer needle.

For loop-forming textile machines, transfer needles that are arranged to transfer a loop that has been received onto another needle are known.

From German Patent Disclosure DE 199 05 668 A1, one such transfer needle is known. It has a needle body with an elongated shank, which defines a needle back and needle side faces. The shank is subdivided into one high portion and one low portion. The high portion is provided on one side face with an indentation, which serves to receive an approximately rectangular fastening portion of a transfer spring. The rectangular portion is located in the pocket, and on its upper edge and lower edge it rests on the flanks of the packet. The depth of the pocket is slightly greater than the thickness of the fastening portion of the transfer spring. For securing the transfer spring in the pocket, swaged points can be provided. From this patent, a transition edge can also be found between the receiving pocket of the fastening portion of a transfer spring and the needle taper; this edge is needed so that a needle can penetrate between the needle shank and the transfer spring in order to take on a loop.

A similar transfer needle is known from German Patent DE 284 7972 C2. Once again, then needle shank is provided on its side face with an indentation, which receives the fastening portion of the transfer spring. Above and below the indentation, a striplike region of the side face or flank of the shaft of the transfer spring remains, which guides the needle in the needle track into which the needle is inserted.

It in also known, for instance from Japanese Patent Disclosure JP 59-211661, to place the transfer spring against a flat side of the needle shank, without providing the shank with an, indentation for receiving any fastening portion whatever. This is a specialized design that is not suitable for all knitting machines.

Fastening a transfer spring in a lateral recess of the needle shank is also known from Japanese Patent Disclosure JP 56-101960, JP 57-167797, and JP 6-38140.

In this design, a great deal of attention must be given to correctly fastening the transfer spring in the pocket. If the transfer spring comes loose, this can cause very serious problems.

With the above as the point of departure, it is the object of the invention to create a needle with a transfer spring that is retained on the needle in captive fashion in a simple, sturdy way.

This object is attained with a needle as defined by claim 1.

The needle of the invention has a needle body, which has two flanks for guidance in a needle track. A slit of elongated shape is embodied in the needle body and extends into the needle body between the two flat sides or flanks. The long side of the slit thus opens out at a narrow side of the needle body, preferably on its top side. The top side of the needle body is the side from which a butt protrudes and toward which a hook embodied on the end of the needle points. If needed, however, the slit can also open out at the needle back. The needle back is the narrow side that, when the needle is inserted into the needle track of a knitting machine, rests on the bottom of the needle track. The slit is open at its face end in the direction of the hook of the knitting machine needle.

Retaining the transfer spring in a slit disposed between the two flanks has the advantage that the flanks can be embodied as entirely or nearly entirely closed surfaces.

Unlike the prior art, the flanks of the needle body rest over a large area on the side faces of the needle track. There is no open pocket here in which dirt such as oil, fiber residues, abraded material and the like could collect. In a needle according to the invention, the load-bearing part of the flank, which is disposed closer to the spring, is lengthened by the length of the pocket used in the prior art. As a result, both flanks of the needle body have a proportionally large load-bearing area. This leads to improved guidance of the needle shank, and as a result the lateral deflections of the needle that occur in operation are reduced. This in turn has advantageous effects on the operating properties of the needle of the invention. For instance, because there is less lateral deflection of the needle, the penetration of a needle that is taking on the loop into the space defined between the transfer sprig and the needle body is very secure. On the other hand, margins of safety and dimensional allowances can thus be reduced.

Because of the proportionally large load-bearing area of the flanks of the needle body, wear of the needles and of the side faces of the needle tracks can be reduced here. Moreover, because of the avoidance of collections of dirt in the lateral pockets that were provided earlier, the smooth running of the needles in the needle track can be assured.

In the needle of the invention, the transfer spring, as in conventional needles, is curved laterally away from the needle body during the transfer process by the needle, which is taking on the loop and which penetrates at an angle. The forces to be transmitted from the needle body by the fastening portion of the transfer spring are thus oriented at an angle to the needle body. One force component is oriented essentially perpendicular to the flat sides of the needle. In the needle of the invention, the slit in turn extends transversely or at an angle to these forces; that is, the fastening portion of the transfer spring is caught between two faces with regard to these forces. By comparison, the opening direction of the receiving pocket for the fastening portion of the transfer spring in the prior art essentially is the same as the direction of action of the forces. While the forces engaging the spring in the prior art thus put a burden on the swaged points or other fastening means that retain the fastening portion in the pocket, this is not the case in the needle of the invention. In the invention, any fastening means, such as welded points, soldered points, adhesively bonded points, swayed points, and the like, serve solely to prevent slipping or loss of the transfer spring in its slit, but the forces to be absorbed in the operation of the needle act precisely not upon the connection points but instead are intercepted over a large area. Because of how the slit is disposed in the needle body, the transfer spring is embedded with its fastening portion inside the needle body.

In a preferred embodiment of the needle of the invention, the depth of the slit is at least as great as the height of the anchoring portion of the transfer spring. As a result, the anchoring portion disappears entirely in the slit, or at least is flush with the plane of the top side of the needle. Preferably, the thickness of the anchoring portion of the transfer spring also matches the width of the slit. AS a result, the anchoring, portion of the transfer spring rests essentially without play in the slit. Force transmission over a large area is made possible.

Preferably, the depth of the slit exceeds half the height of the needle body. As a result, transfer springs with a high anchoring portion can be used, which permits secure fastening of the transfer spring in the slit.

The slit can in principle be embodied as continuous. Preferably, however, it has a bottom, either in the vicinity of the back side of the needle or in the vicinity of the top side of the needle. In this design, a stale needle body is obtained without excessive weakening.

For positioning and/or fastening the transfer spring, positive-engagement elements, for instance in the form of swaged points, or fastening points in the form of adhesively bonded, welded or soldered connections, can be provided. With them, the transfer spring can be positioned and/or fastened in the slit even if the depth or length of the slit has a relatively wide variation in production.

In the needle of the invention, the elongated inner edge of the slit pointing away from the spring is preferably disposed in the same plane as the outer face of the needle shank, in the region of the shanks taper. Hence there is no transitional edge between the receiving slit for the transfer spring and the end region of the shank taper for receiving a needle that is taking on a loop. Thus yet another point where dirt can collect and be deposited can be eliminated without substitution.

Further details of advantageous embodiments of the invention are the subject of the drawing, description, or dependent claims.

Figure 2:
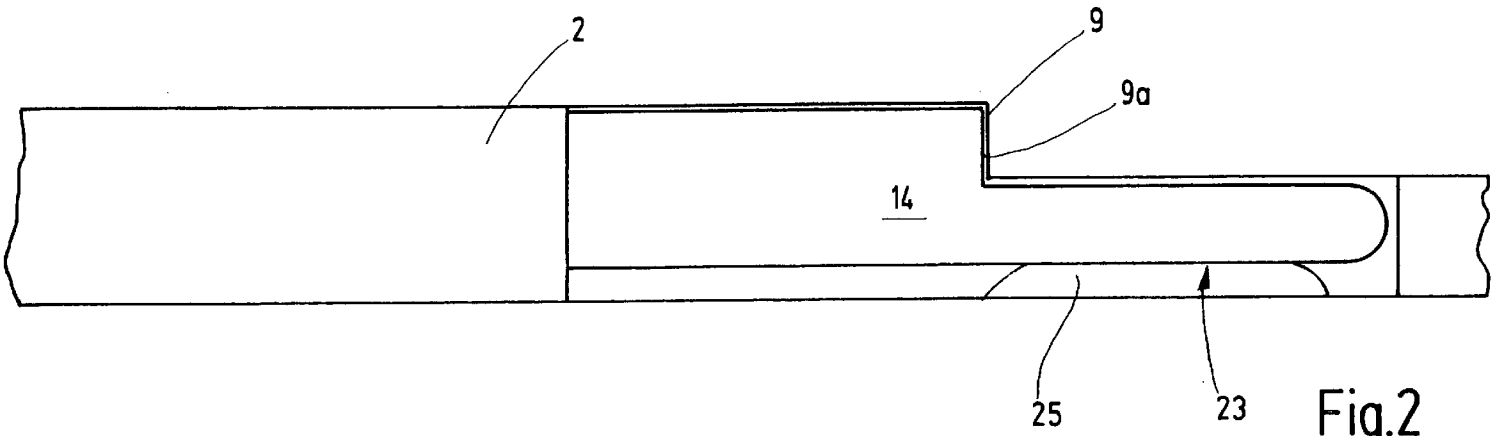
Figure 3:
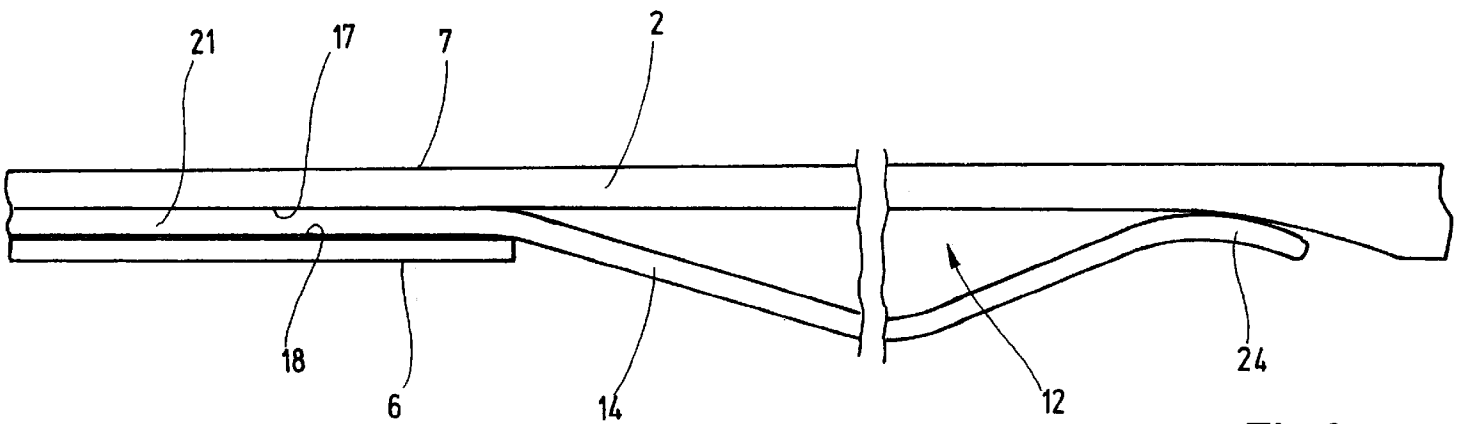
Figure 4:
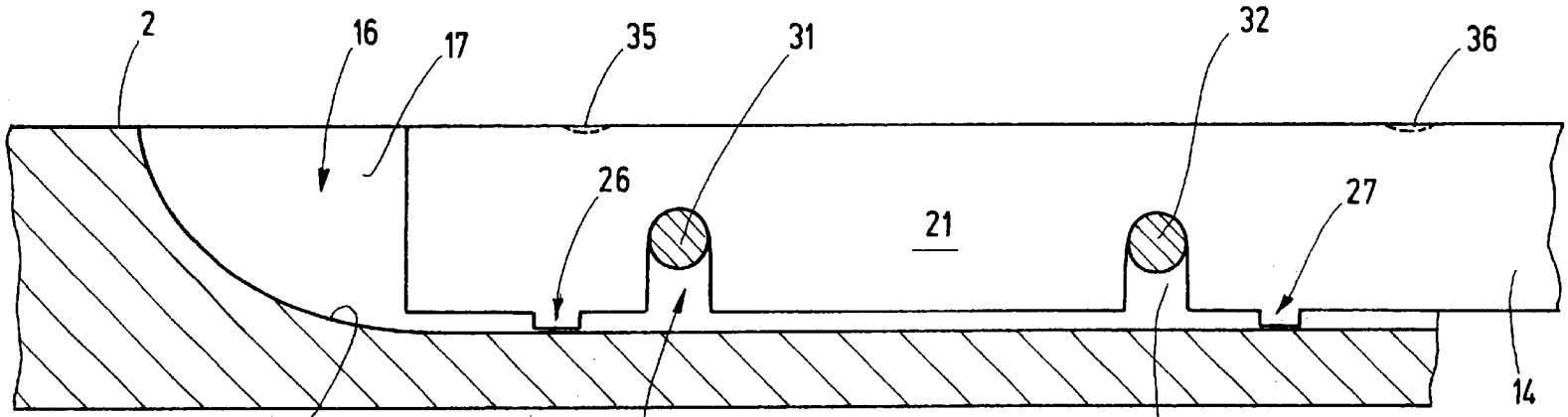
Figure 5:
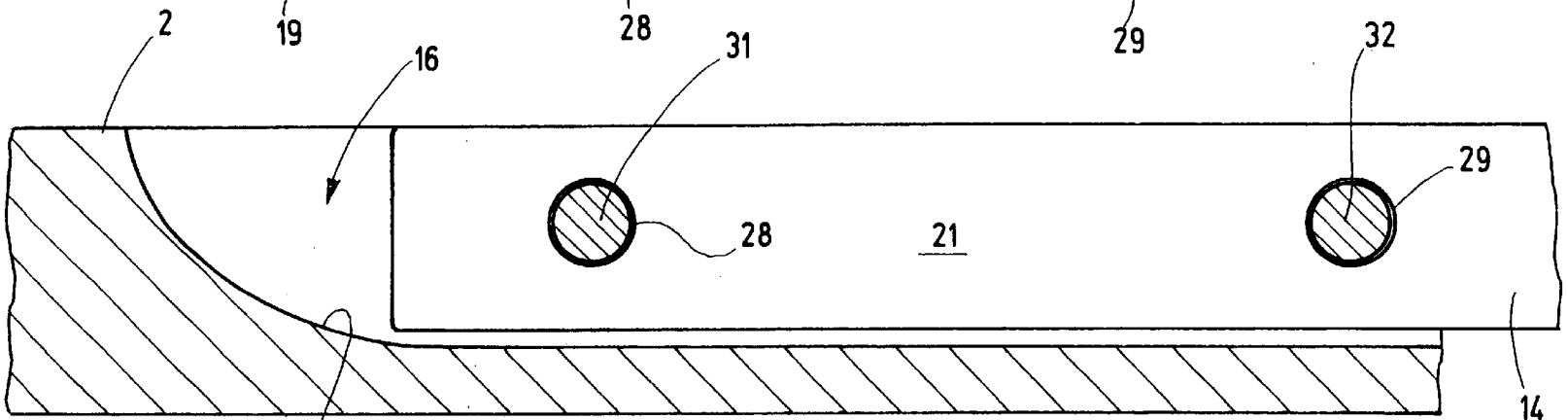

In the drawing, one exemplary embodiment of the invention is shown. Shown are:

FIG. 1, a needle of the invention, in a schematic, perspective, fragmentary view;

FIG. 2, the needle of FIG. 1 in a side view;

FIG. 3, the needle of FIG. 1 in a top view;

FIG. 4, a sectional view through a first embodiment of the needle of FIG. 1; and FIG. 5, a sectional view of a further embodiment of a needle as shown in FIG. 1.

LIST OF REFERENCE NUMERALS

1 Needle
2 Needle body
3 End
4 Needle butt
5 Narrow side
6, 7 Flat side
8 Narrow side
9 Step
11 Point
12 Recess
14 Transfer spring
15 Hollow throat
16 Slit
17, 18 Flanks of slit
19 Bottom of slit
21 Fastening portion
22 Box spring portion
23 Penetration space
24 Tip
25 Spoon
26, 27 Protrusion
28, 29 Recesses
31, 32 Protuberances
33, 34 Depressions
35, 36 Welded points In FIG. 1, a needle 1 embodied as a transfer needle and intended for a knitting machine is shown in fragmentary form. It has a needle body 2, which on an end that is cut away in FIG. 1 has a hook, not shown. On its other end 3, or at some other suitable point, a needle butt 4 is provided, which protrudes away from a narrow side 5 of the needle body 2, the needle body being essentially rectangular in cross section. The narrow side 5 forms the top side of the needle. To both sides of the narrow side 5, the needle body 2 has two flat sides 6, 7, which form essentially even, closed faces oriented parallel to one another. Parallel to the narrow side 5, there is a further narrow side 8 on the underside of the needle body 2; it forms the needle back.

The height of the needle body 2 to be measured between the narrow sides 5, 8 can vary along the length of the needle body 2. For instance, as shown in FIG. 1, a step 9 may be provided, at which the height decreases toward the hook, not shown. In the region of the flat sides 6, 7, the needle body 2 initially has a constant thickness. At a point 11, the needle body 2 can then be provided with a lateral recess 12, or needle taper, in which a transfer spring 14 is disposed. The flat side 6, which extends from the upper narrow side 5 to the lower narrow side 8 without interruption, then ends at the point 11, while conversely the flat side 7 continues forward toward the hook beyond this point 11.

For supporting the transfer spring 14, the needle body 2 has a recess in the form of a slit 16, which extends from the narrow side 5, and from the end of the flat side 7 oriented toward the hook, on into the needle body 2. Thus the slit 16 has flanks 17, 18, visible for instance in FIG. 3, which are oriented parallel to the flat sides 6, 7. The flank 17 of the slit merges preferably smoothly, without an offset or step, with the recess 12. On its opposite side, the recess 12 can be bounded by a concave, curved surface 15, at which the thickness of the needle body increases to the value otherwise to be measured between the flat sides 6, 7. The slit 16 has a depth, to be measured perpendicular to the narrow side 5, that is markedly greater than its width to be measured perpendicular to the flat sides 6, 7. Preferably, the depth is greater than half the height of the needle body 1 measured between the narrow sides 5, 8. The length of the slit 16 to be measured longitudinally of the needle is at least as great as its depth, but preferably is substantially greater. The shape of the slit 16 can be selected as shown in FIG. 4 or FIG. 5. Between its flat flanks 17, 18, a bottom 19 of the slit is embodied which can be polygonal or, as shown, flat, with a rounded end.

The transfer spring 14 has a fastening portion 21 that is essentially rectangular in outline and that is retained in the slit 16 it serves to retain the transfer spring 14 firmly in the slit 16 in all directions. The fastening portion 21 is adjoined by a box spring portion 22, which with the needle body 2 defines a penetration space 23. The size of the-penetration space 23 is determined by the spring flexing and by the depth of the recess 12. On its free end, the transfer spring 14 rests with its tip 24 on the needle body 2 in resiliently prestressed fashion.

The transfer spring 14 can be adapted in its shape to the shape of the needle body 2. This can be seen for instance from FIG. 2. Parallel to the step 9, a step 9*a* is embodied on the transfer spring 14. The penetration space 23 can moreover be widened in funnel-like fashion by hollowing out or milling out the needle body 2 from below at 25.

The fastening portion 21 can be embodied as in FIG. 4, for example. To create a defined contact of the fastening portion 21 with the bottom 19 of the slit, the fastening portion 21 can be provided on its underside with one, two or more protrusions 26, 27, which protrude like lugs from the lower narrow side of the fastening portion 21. This creates a defined contact, such as a two-point contact, with the bottom 19 of the slit, which allows good orientation of the transfer spring 14 in addition, the transfer spring 14 can be provided with openings or recesses 28, 29, which arrest the fastening-portion 21 nondisplaceably in the axial direction. To that end, the recesses 28, 29, which for instance are U-shaped, and which open toward the bottom 19 of the slit, can receive peglike protuberances 31, 32, which are, for instance created in a swaging machining operation by indenting waves 33, 34 (FIG. 1) into the flat side 6 and/or 7.

The fastening portion 21 can also be designed as shown in FIG. 5. Here, the recesses 28, 29 have the form of circular openings or openings with edges of some other shape. These openings are engaged by the protuberances 31, 32, which thus secure the transfer spring 14. The transfer spring 14 can furthermore be connected to the needle body 2 by one or more connection points 35, 36 (FIG. 4). The connecting point 35, 36 create a connection by material engagement, such as by adhesive bonding, welding, or soldering, which can reinforce or replace the positive-engagement connection that is formed by the protuberances 31, 32 and the recesses 28, 29. Instead of the connecting points 35, 36, a weld seam at the narrow side 5 can also create a connection between the fastening portion 21 and in the needle body 2. It is also possible for the fastening portion 21 to be adhesively bonded, soldered or clamped into the slit 16.

A needle 1 for loop-forming machines has a needle body 2 with two even flat sides 6, 7, which are joined to one another on the top and sides of the needle by narrow sides 5, 8. A narrow slit opens out at one of the narrow sides and extends parallel or at an acute angle to the flat sides 6, 7 into the needle body. A substantially rectangular fastening portion 21 of the transfer spring 14 is retained in this slit 16 by positive and/or nonpositive and/or material engagement.

What is claimed is:

1. A needle for loop-forming textile machines, comprising:

a needle body, which has two opposed flanks, embodied as flat sides, and a recess for receiving a fastening portion of a transfer spring, wherein the recess is a slit which extends between the two flat sides into the needle body.

2. The needle of claim 1, wherein the depth of the slit measured parallel to the flat sides is at least as great as the height, measured in the same direction, of the fastening portion.

3. The needle of claim 1, wherein the width of the slit measured perpendicular to the flat side matches the thickness, measured in the same direction, of the fastening portion.

4. A needle for loop-forming textile machines, comprising:

a needle body, which has two opposed flanks, embodied as flat sides, and a recess for receiving a fastening portion of a transfer spring, wherein the recess is a slit which extends between the two flat sides into the needle body, and the depth of the slit exceeds half the height of the needle body.

5. The needle of claim 1, wherein the slit has a slit bottom.

6. The needle of claim 1, wherein the slit is disposed eccentrically in the needle body.

7. The needle of claim 1, further comprising positive-engagement elements disposed in the slit and for positioning and/or fastening the transfer spring.

8. The needle of claim 1, wherein the slit is defined on both sides by closed slit walls.

9. The needle of claim 1, wherein the fastening portion is retained in the slit by material engagement.

10. The needle of claim 1, wherein the fastening portion is retained in the slit by a deformed protuberance.

11. The needle of claim 8, wherein the slit wall merges continually without a step with the needle recess.

* * * * *